US006764278B2

(12) United States Patent
Ozawa et al.

(10) Patent No.: US 6,764,278 B2
(45) Date of Patent: Jul. 20, 2004

(54) WATER PUMP

(75) Inventors: Yasuo Ozawa, Kariya (JP); Junya Yamamoto, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 52 days.

(21) Appl. No.: 10/151,951

(22) Filed: May 22, 2002

(65) Prior Publication Data

US 2002/0176773 A1 Nov. 28, 2002

(30) Foreign Application Priority Data

May 22, 2001 (JP) ..... 2001-153022

(51) Int. Cl.[7] ..... F04D 29/04
(52) U.S. Cl. ..... 415/124.2; 415/229; 415/915
(58) Field of Search ..... 415/124.2, 170.1, 415/229, 915; 416/60, 169 A, 174, 213 A, 244 R; 417/362

(56) References Cited

U.S. PATENT DOCUMENTS 4,402,647 A * 9/1983 Effenberger ..... 415/90
4,955,786 A * 9/1990 Kunkel et al. ..... 415/229
4,966,572 A 10/1990 Kunkel et al.
5,026,253 A * 6/1991 Borger ..... 415/229
5,125,795 A 6/1992 Suzuki et al.
5,217,350 A * 6/1993 Kimura et al. ..... 415/175
5,224,823 A * 7/1993 Cordts ..... 417/362
5,720,685 A 2/1998 Malone
6,120,243 A 9/2000 Tanabe
6,200,089 B1 * 3/2001 Heer ..... 417/362
2002/0034438 A1 3/2002 Ozawa et al.

FOREIGN PATENT DOCUMENTS

| | | |
|---|---|---|
| EP | 0 289 958 | 4/1988 |
| GB | 1386937 | 4/1973 |
| JP | 63-302200 | 5/1988 |
| JP | 4-262096 | 12/1990 |

OTHER PUBLICATIONS

European Search Report.

* cited by examiner

*Primary Examiner*—Edward K. Look
*Assistant Examiner*—Richard A. Edgar
(74) *Attorney, Agent, or Firm*—Reed Smith LLP; Stanley P. Fisher, Esq.; Juan Carlos A. Marquez, Esq.

(57) ABSTRACT

A water, pump includes a driven portion, a shaft connected to the driven portion, an impeller connected to the shaft, and a body supporting the driven portion for relative rotation therewith. The water pump is characterized in that the driven portion and the shaft are formed integrally by resin molding, and an outer surface of the bearing is fixed to the driven portion.

7 Claims, 4 Drawing Sheets

WATER PUMP

CROSS REFERENCE TO RELATED APPLICATIONS

This application is based on and claims priority under 35 U.S.C. § 119 with respect to Japanese Application No. 2001-153022 filed on May 22, 2001, the entire content of which is incorporated herein by reference.

FIELD OF THE INVENTION

This invention generally relates to a water pump mechanism. More particularly, the present invention pertains to a water pump which is used for a vehicle.

BACKGROUND OF THE INVENTION

A known water pump for a vehicle use is disclosed in U.S. Pat. No. 4,966,572. This known water pump, as shown in FIG. 4, includes an impeller 41 and a pulley 42, and the pulley 42 is press-fitted to a shaft which rotates integrally with the impeller 41, and the pulley 42 rotates by receiving the torque from outside. An outer ring of a bearing 43 is fitted to an inner ring of the pulley 42 which is press-formed with a steel plate, and a body 44 which is fitted in an inner periphery of the bearing 43 is supporting the pulley 42 through the bearing 43. According to a required specification of an engine to which a water pump is assembled, a diameter of a pulley, which receives torque for driving a water pump, needs to be changed. However, because the known water pump is structured with the outer ring of the bearing 43 fitted to an inner surface of the pulley 42, and the body 44 supports the pulley 42 through the bearing 43, an outer diameter of the pulley 42 is not so different from an outer diameter of the bearing 43. Therefore, the designing choice of the diameter of the pulley is limited.

Also, as a problem of a press-formed pulley, if a thick steel plate is press-formed to secure strength of the pulley, it is assumed that formation becomes difficult and a dimensional accuracy (cylindricality or vibration etc) of the press-formed pulley is reduced. On the other hand, if a thin steel plate is used for simplifying the formation process and improving the dimensional accuracy after formation, the strength of the pulley may decrease, and when the pulley is fitted to a bearing, the pulley may be deformed, impairing the dimensional accuracy (cylindricality or vibration, etc.), or the fitting strength between the pulley and the bearing may decrease.

SUMMARY OF THE INVENTION

According to one aspect of the invention, a water pump includes a driven portion, a shaft which is connected to the driven portion, an impeller which is connected to the shaft, a body which supports the driven portion for relative rotation therewith through a bearing, characterized in that an outer surface of the bearing is fixed together with the driven portion, and the driven portion and the shaft are formed integrally by resin molding.

According to this aspect, a driving force, which is inputted to the driven portion, rotates the impeller through the shaft, which is integrally formed with the driven portion.

According to another aspect of the invention, the water pump includes the driven portion, the shaft which is connected to the driven portion, the impeller which is connected to the shaft, the body which supports the driven portion for relative rotation therewith through the bearing, characterized in that the outer surface of the bearing is fixed together with the driven portion, the driven portion is comprised of a pulley portion and an arm portion, the pulley portion is fixed to the arm portion, and the arm portion is fixed to the outer surface of the bearing and is connected to the shaft.

According to this aspect, the driving force, which is inputted to the driven portion comprised of the pulley portion and the arm portion, rotates the impeller through the shaft, which is connected to the driven portion.

BRIEF DESCRIPTION OF THE DRAWING FIGURES

The foregoing and additional features and characteristics of the present invention will become more apparent from the following detailed description of a preferred embodiment thereof when considered with reference to the attached drawings, in which.

DETAILED DESCRIPTION OF THE INVENTION

Embodiments of this invention will be explained with reference to the attached drawings.

Figure 1:
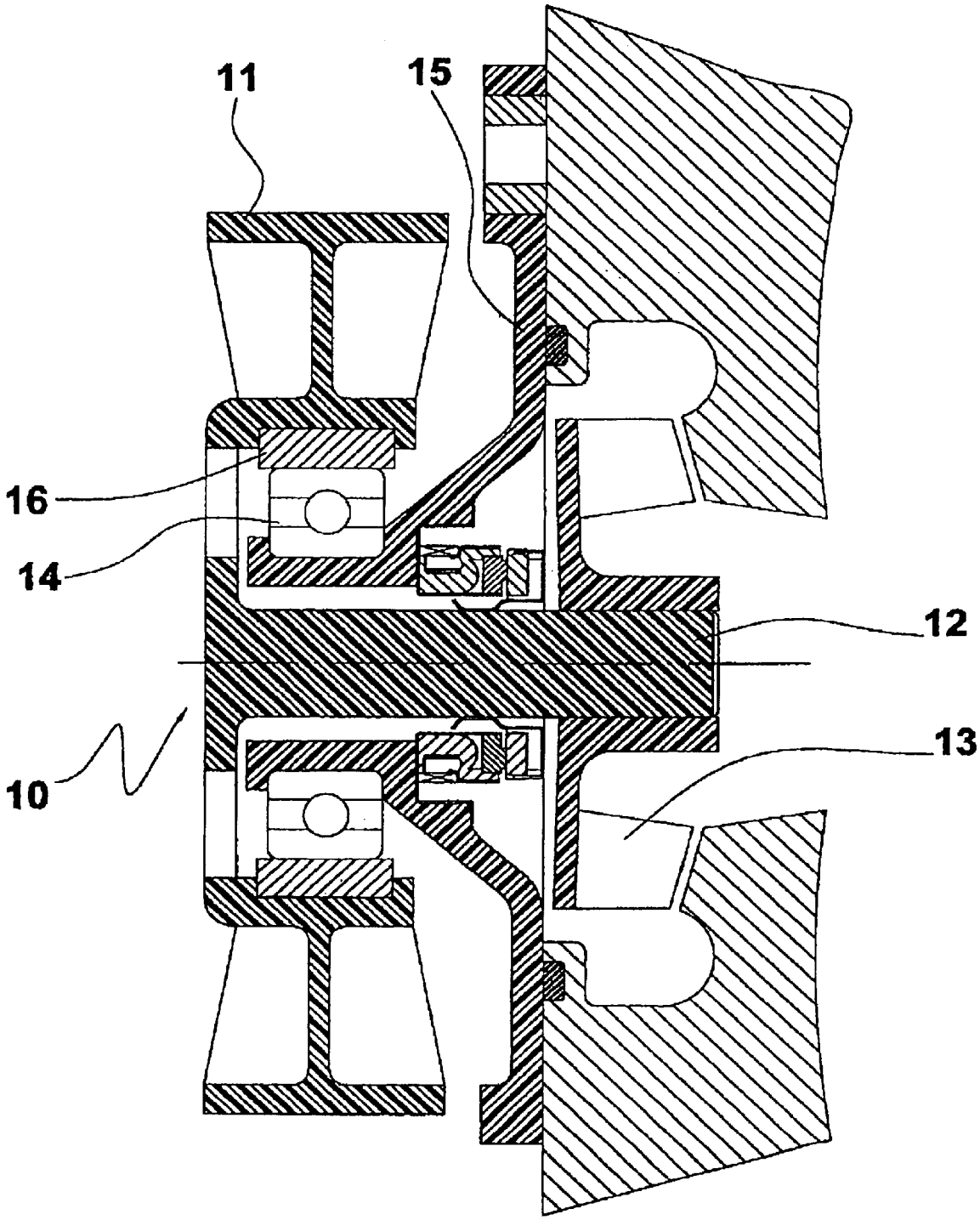
FIG. 1 is a cross-sectional view of a water pump according to a first embodiment of the invention.

FIG. 1 is a cross-sectional view of a water pump 10 for the first embodiment.

A pulley 11, an annular metal insert 16, and a shaft 12 are respectively installed coaxially, and upon formation process, they are formed integrally with resin by insert molding which inserts the metal insert 16 and molds with resin by injection molding.

The annular metal insert 16 is fixed by being embedded on its outer periphery to an inner surface of the pulley 11. On the other hand, an inner periphery of the metal insert 16 is installed projecting toward the center of rotation of the pulley 11.

An impeller 13 is made of resin, and connected to the shaft 12, which is also made of resin by vibrational welding for unitary rotation with the shaft 12.

An inner ring of a bearing 14 is formed integrally with a body 15, which is made of resin, by insert molding, and the inner ring of the bearing 14 is embedded in the body 15 in order not to move either in an axial or a circumferential direction. The pulley 11 is press-fitted to an outer ring of the bearing 14 through the metal insert 16 which is installed on the inner peripheral surface of the pulley 11 projecting toward the center of rotation. The metal insert 16 is installed to assure fitting strength between an outer ring of the bearing 14 and the pulley 11, both of which are made of resin.

By the above structure, the body 15 supports the pulley 11 for relative rotation. A belt, not shown, is disposed on an outer peripheral surface of a rim portion of the pulley 11, and the pulley 11 is driven by torque from a crankshaft of an engine through the belt. The torque from the pulley 11 is then transmitted to the impeller 13 through the shaft 12, the impeller 13 starts to rotate, and the water pump 10 is operated.

In the first embodiment, the pulley 11 and the shaft 12 are molded integrally by resin. Therefore, compared to the press-forming, a wide range of design choice is available and the process limitations are reduced. Also, compared to the press-forming, molding by resin improves the dimensional accuracy (cylindricality or vibration, etc.) by choosing molding temperature and material. Furthermore, complicated molding can be achieved easily.

In addition, by molding the pulley 11 and the shaft 12 integrally, processes such as fixing the shaft 12 to the pulley 11, which is required when the pulley 11 and the shaft 12 are formed by separate members, becomes unnecessary. Furthermore, by molding the pulley 11 and the shaft 12 integrally, the vibration upon assembling this pulley 11 and the shaft 12 is prevented, and the coaxiallity between the pulley 11 and the shaft 12 will improve.

Figure 2:
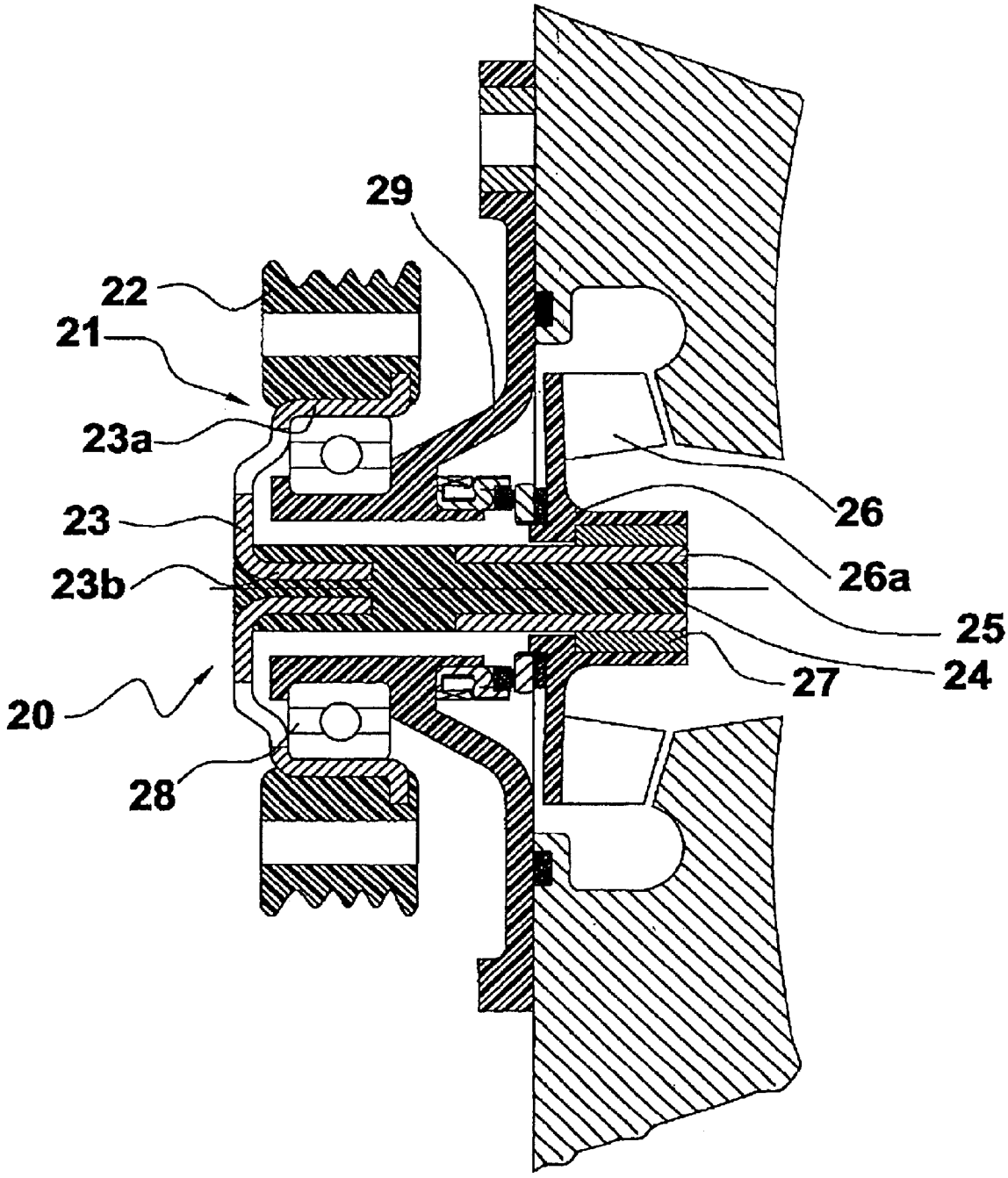
FIG. 2 is a cross-sectional view of the water pump according to a second embodiment of the invention.

FIG. 2 is a cross-sectional view of a water pump 20 for the second embodiment. A pulley 21 is comprised of a pulley portion 22 and an arm portion 23. The arm portion 23 is a cylindrical metal portion and is formed by press deep-draw molding and, as shown in FIG. 2, the arm portion 23 has an outer wall 23*a* and an inner wall 23*b*.

The pulley 21 and a shaft 24 are installed coaxially and they are formed integrally, inserting the arm portion 23 by injection molding with resin. An outer portion of the outer wall 23*a* of the arm portion 23 is embedded and fixed to the pulley portion 22. Also, the inner wall 23*b* of the arm portion 23 is embedded and fixed to an end of the shaft 24. A tubular metal spacer 25 is embedded and fixed to an outer periphery of the other end of the shaft 24. The outer surface of the spacer 25 is exposed from the shaft 24.

An impeller 26 is made of resin, and an outer portion of an annular metal insert 27 is embedded and fixed to an inner surface 26*a* of the impeller 26. An inner portion of the metal insert 27 is installed projecting toward the center of rotation of the impeller 26. The impeller 26 is press-fitted to the other end of the metal spacer 25 of the shaft 24 through the metal insert 27 which is installed projecting toward the center of rotation. The metal insert 27 and the metal spacer 25 are installed to assure fitting strength between the shaft 24 and the impeller 26, both of which are made of resin.

An inner ring of a bearing 28 is formed integrally with a body 29, which is made of resin, by insert molding, and the inner ring of the bearing 28 is embedded in the body 29 in order not to move either in an axial or a circumferential direction. At the pulley 21, an inner surface of the outer wall 23*a* of the arm portion 23 is press-fitted to an outer surface of the bearing 28.

By the above structure, the body 29 is supporting the pulley 21 through the bearing 28 for relative rotation. A belt, not shown, is disposed on an outer peripheral surface of the pulley portion 22 of the pulley 21, and the pulley 21 is driven by torque from a crankshaft of an engine through the belt. The pulley 21 transmits the torque to the impeller 26 through the shaft 24, the impeller 26 starts to rotate, and the water pump 20 is operated.

In the second embodiment, the pulley 21 is formed integrally with the pulley portion 22, which is made of resin, and the arm portion 23, which is made of metal, by insert molding. Because the pulley portion 22 is formed by resin molding, the process, limitations and the design limitation are reduced and a wide range of the design choices of the pulley portion 22 is available. Also, compared to the press-forming, molding by resin enables the improvement of the dimensional accuracy (cylindrically or vibration, etc). Furthermore, complicated molding can be achieved easily, for instance, the one which is indicated in the cross-section of an outer peripheral surface of a rim portion of the pulley portion 22 is shown in FIG. 2.

Dimensional errors (cylindricality, vibration, coaxial degree, parallelism of dimensions) may occur because the arm portion 23 is formed by deep-draw press forming. However, because the arm portion 23, the pulley portion 22 and the shaft 24 are fixed integrally by insert molding, some of the dimensional errors are absorbed. Consequently, the sum of dimensional errors of the pulley as a whole is kept low.

Figure 3:
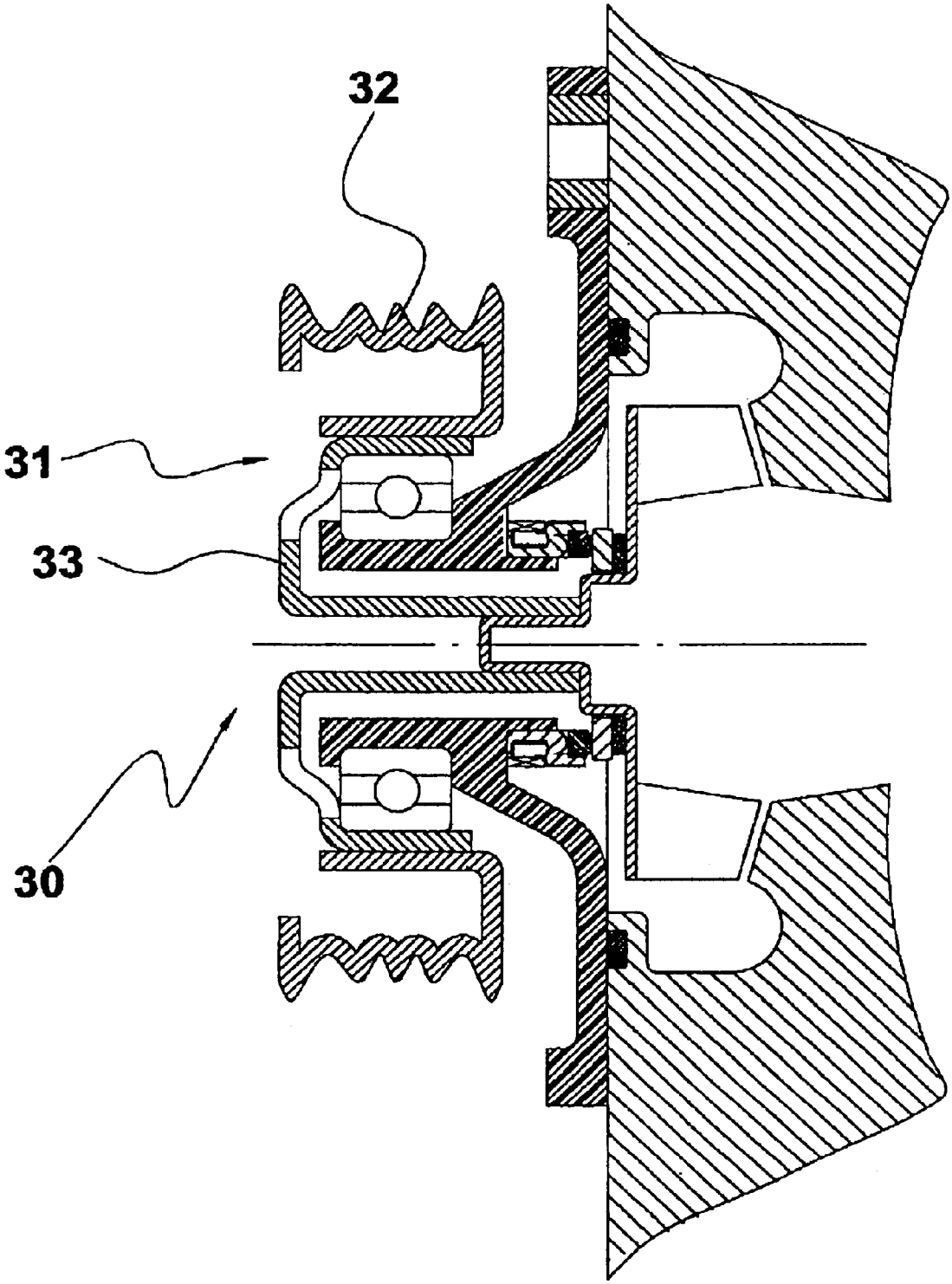
FIG. 3 is a cross-sectional view of the water pump according to a third embodiment of the invention.
Figure 4:
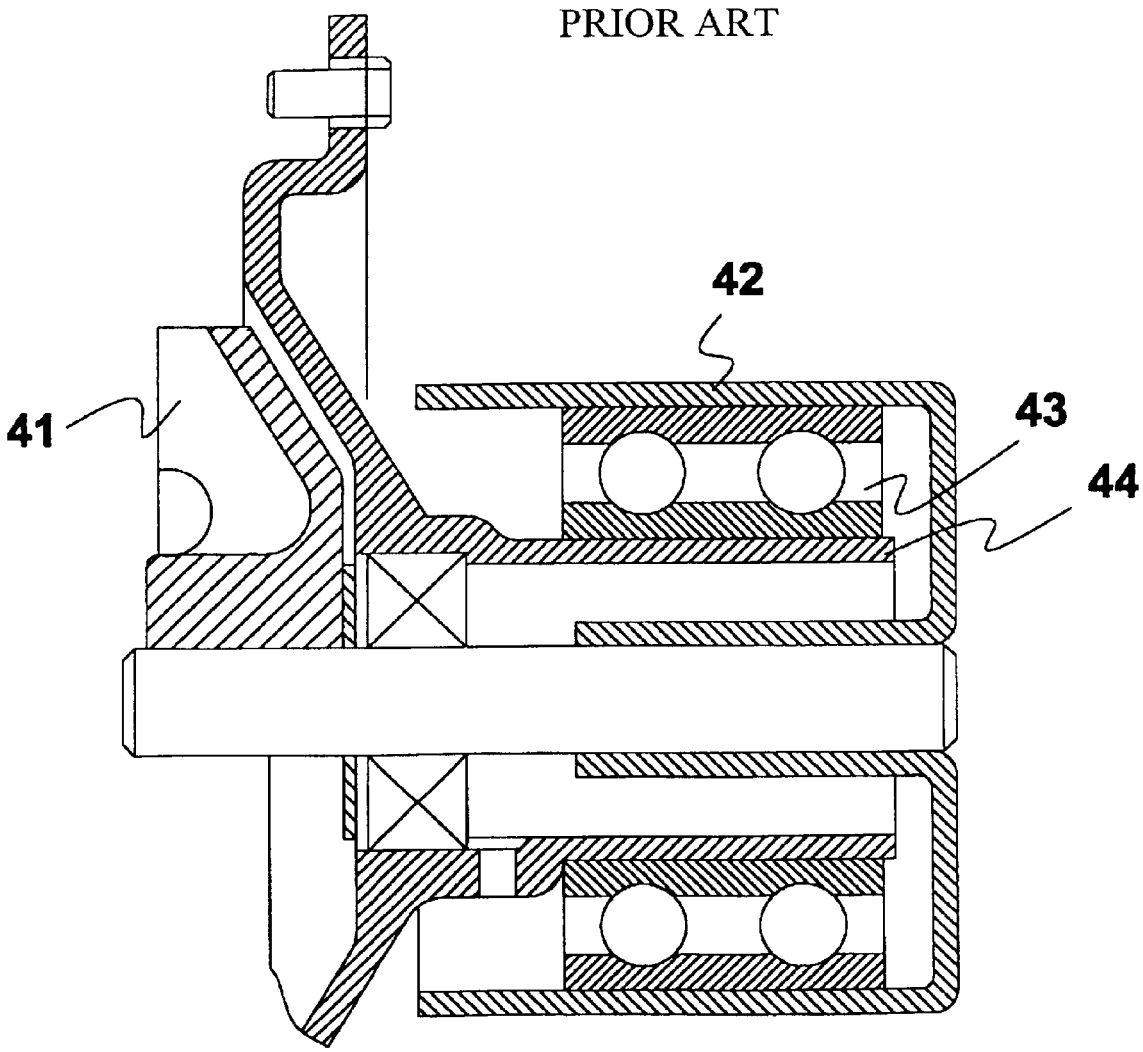
Fig.4 PRIOR ART
FIG. 4 is a cross-sectional view of a water pump of a known art.

FIG. 3 is a cross-sectional view of a water pump 30 of the third embodiment. The pulley portion 22, which is made of resin, of the second embodiment is replaced with a press-formed metal rim portion 32 of a pulley 31. The metal rim portion 32 of the pulley 31 is press-formed (and roll-formed), and press-fitted to an arm portion 33. Therefore, a wide range of the design choice of the outer diameter of the pulley 31 is available. Also, by separating the rim portion 32 from the arm portion 33, and connecting them after press molding, the number of the dimensional errors by making the process complicated and increasing a number of processes is kept low.

By molding a driven portion such as a pulley with resin, processing limitation is reduced. It also enables the length of the outer diameter of the driven portion to adjust freely and precisely according to the required specification of an engine to which a water pump is assembled. This means that one type of a water pump can be used for many types of engines.

Also, by adjusting temperature conditions and other conditions such as a selection of resin materials during injection molding, molding by resin can improve the dimensional accuracy of the formed component more easily than press forming. In addition, productivity is improved because there are fewer processes for molding by resin than processes for press molding.

Furthermore, since the driven portion and a shaft are formed integrally by resin, it not only improves the coaxial degree of the driven portion and the shaft (reducing vibration of the pulley relative to the shaft), but it also reduces the production cost and manpower.

Moreover, if the driven portion is comprised of a pulley portion and an arm portion which is fixed to the pulley portion, it would enable the diameter and shape of the driven portion to be determined freely by merely changing the shape of the pulley. This means that one type of a water pump can be used for many types of engines.

What is claimed is:

1. A water pump comprising:

a driven portion;

a shaft which is connected to the driven portion;

an impeller which is connected to the shaft, and a body which supports the driven portion for relative rotation therewith through a bearing, wherein an outer surface of the bearing is fixed to the driven portion, wherein the driven portion and the shaft are formed integrally by resin molding, and wherein an annular insert is fixed by being embedded on its outer periphery to an inner surface of the driven portion and the inner periphery of the said annular insert is press-fitted to an outer ring of the bearing.

2. A water pump as recited in claim 1, wherein the impeller is made of resin, and connected to the shaft which is made of resin by vibration welding for unitary rotation with the shaft.

3. A water pump as recited in claim 1, wherein an inner ring of the bearing is formed integrally with the body by insert molding and the inner ring of the bearing is embedded in the body.

4. A water pump comprising:

a driven portion;

a shaft which is connected to the driven portion;

an impeller which is connected to the shaft; and a body which supports the driven portion for relative rotation therewith through a bearing, wherein an outer surface of the bearing is fixed to the driven portion, the driven portion is comprised of a pulley portion and an arm portion, and the pulley portion is fixed to the arm portion, wherein the arm portion has an outer wall and an inner wall, is fixed to an outer surface of the bearing, and is connected to the shaft, the outer wall of said arm portion is positioned between said outer surface of the bearing and an inner surface of said pulley portion, and the inner wall of the arm portion is embedded and fixed to the shaft.

5. A water pump as recited in claim 4, wherein the arm portion is a cylindrical metal portion and an inner surface of said outer wall is press-fitted to the said outer surface of the bearing.

6. A water pump as recited in claim 4, wherein a tubular metal spacer is embedded and fixed to an outer periphery of the end of the shaft and the outer surface of said spacer is exposed from the shaft.

7. A water pump as recited in claim 4, wherein an inner ring of the bearing is formed integrally with the body by insert molding and the inner ring of the bearing is embedded in the body.

* * * * *